US009419348B2

(12) United States Patent
Krach et al.

(10) Patent No.: US 9,419,348 B2
(45) Date of Patent: Aug. 16, 2016

(54) CONNECTING ARRANGEMENT WITH A CRIMP CONNECTOR AND A WIRE FIXED IN PLACE TO THE CRIMP CONNECTOR

(71) Applicant: Actuator Solutions GmbH, Treuchtlingen (DE)

(72) Inventors: Martin Krach, Pleinfeld (DE); Markus Köpfer, Regelweiler (DE)

(73) Assignee: Actuator Solutions GmbH, Treuchtlingen (DE)

( * ) Notice: Subject to any disclaimer, the term of this patent is extended or adjusted under 35 U.S.C. 154(b) by 0 days.

(21) Appl. No.: 14/854,332

(22) Filed: Sep. 15, 2015

(65) Prior Publication Data

US 2016/0118723 A1 Apr. 28, 2016

(30) Foreign Application Priority Data

Oct. 22, 2014 (DE) ..... 10 2014 115 393

(51) Int. Cl.
*H01R 4/10* (2006.01)
*H01R 4/18* (2006.01)

(52) U.S. Cl.
CPC ..... *H01R 4/18* (2013.01)

(58) Field of Classification Search
CPC ..... H01R 4/185; H01R 4/188
USPC ..... 439/877, 881; 310/71 R; 174/84 C
See application file for complete search history.

(56) References Cited

U.S. PATENT DOCUMENTS 3,523,173 A 8/1970 Lull
3,541,227 A * 11/1970 Bendrick ..... H01R 4/182 174/84 C
3,728,473 A * 4/1973 Kuo ..... H01R 4/2495 174/84 C (Continued)

FOREIGN PATENT DOCUMENTS

DE 10 2004 036 829 3/2006
DE 102013217000 2/2014
JP 2013207865 10/2013

OTHER PUBLICATIONS

Machine Translation of portion of German Office Action for German Application No. 10 2014 115 393.6, dated Aug. 7, 2015.

*Primary Examiner* — Phuong Dinh
(74) *Attorney, Agent, or Firm* — JK Intellectual Property Law, PA

(57) ABSTRACT

The connection refers to a connecting arrangement with a crimp connector (2) and a wire (3) fixed in place to the crimp connector. The crimp connector encompasses two clamping plates (4, 5) executed as one piece that, in a mounted state, clamp the wire (3) between them and while doing, so fix the wire (3) firmly in place with a force acting in longitudinal axial load direction (B). At least in the mounted state, the inner surfaces of the clamping plates face one another and are at least partially executed as level clamping surfaces (4*a*, 5*a*). In the mounted state, the clamping surfaces (4*a*, 5*a*) of the clamping plates (4, 5) make contact with one another, whereby an area of the wire section (3') is pressed partially inside the one clamping plate and partially inside the other clamping plate (4, 5). At least one clamping plate (4, 5) has at least one back gripping surface (8) colliding with its clamping surface (4*a*, 5*a*) facing against the load direction (B) and extending transversally to the load direction (B), whereby the clamping surface (4*a*, 5*a*) of the other clamping plate (4, 5) extends beyond the back gripping surface (8) against the load direction (B).

9 Claims, 6 Drawing Sheets

(56) References Cited

U.S. PATENT DOCUMENTS

| | | | | |
|---|---|---|---|---|
| 3,852,702 | A | 12/1974 | Dowling | |
| 4,034,152 | A | 7/1977 | Warner | |
| 6,855,409 | B1 | 2/2005 | Urushizaki et al. | |
| 2013/0244511 | A1* | 9/2013 | Van Tilburg | H01R 4/10 439/877 |

* cited by examiner

CONNECTING ARRANGEMENT WITH A CRIMP CONNECTOR AND A WIRE FIXED IN PLACE TO THE CRIMP CONNECTOR

TECHNICAL FIELD

The invention refers to a connecting arrangement that encompasses a crimp connector and a wire fixed in place or to be fixed in place to the crimp connector. A wire here is understood to be either a single filament or a single thread or, for example, a bundle of filaments developed like a strand. The crimp connector encompasses two clamping plates with a longitudinal wire section (e.g. a wire end) clamped between them.

BACKGROUND

In case of tensile-stressed wires such as spontaneously shortening wires from a shape memory alloy when a current is applied, care must be taken to ensure that the wire is not only electrically, but also firmly and mechanically connected to the crimp connector. For this purpose, often a form-fitting joint effective in the direction of the tensile load is aimed for in addition to the force-fitting joint accomplished by the clamping effect of the clamping plates. This can be accomplished by having a projection protruding from the interior of a clamping plate of one of the clamping plates of the crimp connector that contains the wire between them, and a recess opposite it in the interior of the other clamping plate. When the clamping plates are pressed together, the wire is pressed from the projection into the recess and is subject to considerable deformation. Therefore, this type of crimp connection cannot be used in delicate wires that would not resist the above-mentioned deformation.

Such a conductor connecting structure is known from DE 10 2013 217 000 A1, in which a conductor is enclosed between two plate-shaped holding parts. The first holding part has projections on one side facing the conductor, while the second holding part has through-holes that correspond to the position of the projections. If the conductor is clamped between the two holding parts, it is deformed by the projections in such a way that it is pushed into the through-holes and pressed firmly inside them.

DE 10 2004 036 829 A3 describes an electric bonding of a wire with two opposite plates, whereby a plate encompasses one bonding area and a recess corresponding to the bonding area and the wire is clamped between the bonding area and the recess.

JP 2013-207865 discloses a connecting clamp in which a wire is clamped and fixed in place between two clamping elements with tooth systems. Compression connectors, in which a conductor is clamped and fixed in place between two clamping plates are also described, for example, in published patents U.S. Pat. No. 6,855,409 B1, U.S. Pat. No. 4,034,152 A, U.S. Pat. No. 3,852,702 A and U.S. Pat. No. 3,523,173 A.

SUMMARY

Therefore, the task of the invention is to provide one crimp connector and one connecting arrangement encompassing a wire to ensure a secure mechanical and electrical connection that does not damage or destroy the wire.

This task is solved by a connecting arrangement according to the disclosure. According to it, the crimp connector encompasses two clamping plates formed as one piece that in mounted state clamp a longitudinal wire section, such as a wire end, in place between them, fixing it firmly in place against the load direction acting on the wire in longitudinal axial fashion. The inner surfaces facing one another—at least in the mounted state of the clamping plates—are at least developed partially as level clamping surfaces. The wire is made of a material that is harder than the material of the clamping plates. When they are mounted, the clamping plates make contact to one another with their clamping surfaces, whereby the size of the longitudinal wire section presses partially into one clamping surface and partially into the other one by displacing the clamping plate material. In this way, the longitudinal wire section is fixed in place to the crimp connector with a force-fitting joint effective in load direction.

Because the wire is embedded in the clamping plate material, wire and clamping plates make a large-surface contact and thus create a force-fitting joint having large tensile strength. Owing to the virtually complete enclosure of the entire wire size by the clamping plate material, the firmness of the force-fitting joint between clamping plates and wire is less sensitive towards tolerances such as the wire thickness or uneven surfaces of the clamping surfaces.

In addition to the wire's force-fitting fixation, a form-fitting joint in load direction is also provided and consists of the following: At least one clamping plate has at least one gripping surface that abuts the clamping surface and faces against the load direction that extends transversally to the load direction. The clamping surface of the other clamping plate extends in opposite direction of the load direction beyond the back gripping surface. A wire section extending away from the front surface of a clamping plate against the load direction is pressed by the clamping surface of the other clamping plate into a back gripping space extending beyond the back gripping surface in opposite direction of the load direction. Here, it is advantageous that to manufacture the form-fitting joint between crimp connector and wire, it only has to be deformed slightly in a direction extending transversally to its longitudinal extension. The distance around which the wire is deflected in the above-mentioned direction is roughly only one-half of the wire diameter because the wire held in clamped fashion is pressed half way into the clamping surface of one of the clamping plates and half way into the clamping surface of the other clamping surface. Contrary to conventional wire connectors with projections and recesses, there is therefore pronounced kink or no shaft-edged bending of the wire is necessary in the transition between a wire section running straight and one that is off-center that could impair its firmness or even lead to a break of the wire in its bent section.

BRIEF DESCRIPTION OF THE DRAWINGS

The invention will now be explained in more detailed way with the help of the attached illustrations, which show.

DETAILED DESCRIPTION

Figure 1:
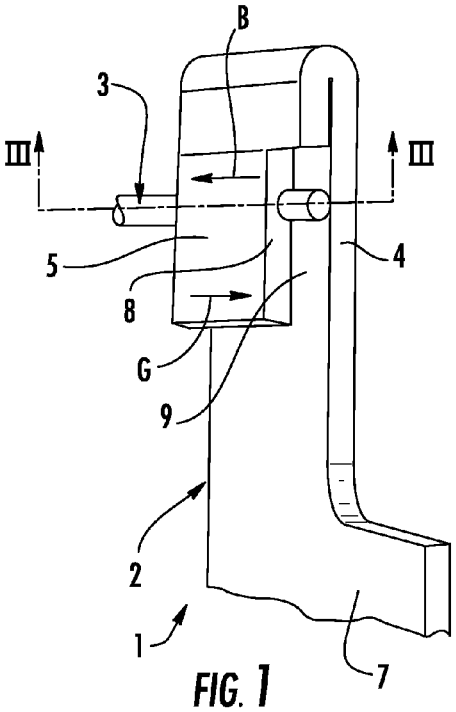
FIG. 1: A partial view in perspective of a first embodiment of a connecting arrangement that encompasses a crimp connector and a wire fixed in place to it, whereby the connecting arrangement is in mounted state, i.e. the wire is tightly connected to the crimp connector.

FIG. 1 shows a simplified embodiment of a connecting arrangement 1. The connecting arrangement encompasses one crimp connector 2 and one wire 3 fixed in place to it. The crimp connector 2 has two clamping plates 4, 5 executed as one piece, that in mounted state enclose a longitudinal wire section 6 between them. By doing this, they fix the wire 3 in place with a force acting on the wire in longitudinal axial load direction B. Thus, the wire 3 is firmly held in the crimp connector. The two clamping plates 4, 5 are executed between them as one piece. The free end of one of the two clamping plates (indicated with reference sign 4 in the embodiments) changes into a base 7 for purposes of fixing to a part (not shown) and has a design that differs from the one of the clamping plate 4 (it can have fixation elements, for example, not shown). In mounted state according to FIG. 1 and in the pre-mounted state according to FIG. 2, the inner surfaces of the clamping plates 4, 5 are executed as level clamping surfaces 4*a*, 5*a*. In the embodiments shown in the illustrations, the inner surfaces 4*a*, 5*a* form as a whole the entire clamping surfaces 4*a*, 5*a*. However, it is also conceivable that only one part of the inner surfaces of the clamping plates 4, 5 are executed as clamping surfaces 4*a*, 5*a*.

In mounted state, the clamping surfaces 4*a*, 5*a* make contact with the clamping plates 4, 5, thereby clamping the wire 3. The wire is made of a material that is harder than the material of the clamping plates 4, 5. Consequently, in the mounted state (in which the clamping surfaces 4*a*, 5*a* make surface contact with one another), a wire section 3' area is pressed into the clamping plates 4, 5 or the clamping surfaces 4*a*, 5*a* thereby displacing the clamping plate material and as a result of this, gutter-shaped depressions 14 are formed. At the same time, the clamping plates 4*a*, 5*a* enclose the wire size completely, thus fixing the wire 3 form-fittingly in place between the clamping plates 4, 5 with a tensile strength, i.e. with a force acting on it in longitudinal axial load direction.

Figure 4:
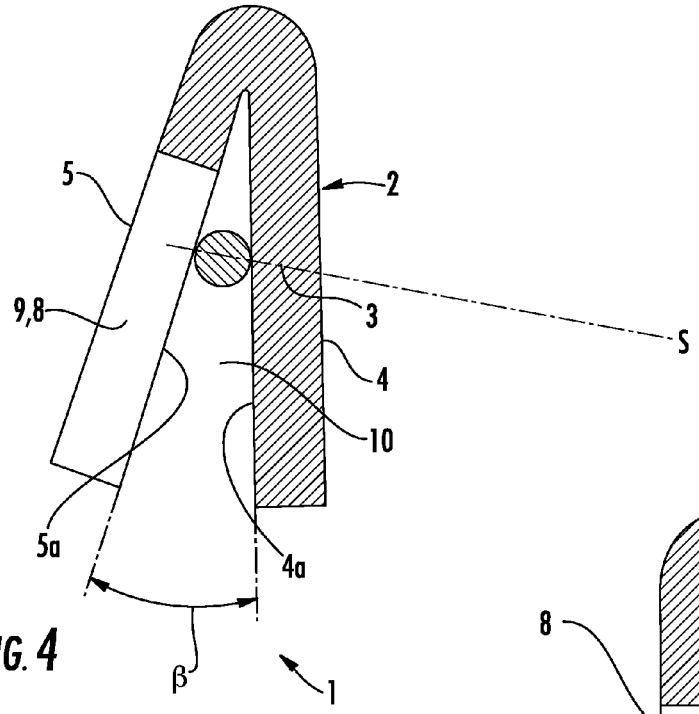
FIG. 4: A cross-sectional view corresponding to line IV-IV in FIG. 2, FIG. 5: A cross-sectional view corresponding to line V-V in FIG. 3, FIG. 6: A cross-sectional view corresponding to line VI-VI in FIG. 3, FIG. 7: A perspective view of another embodiment of a connecting arrangement in mounted state.
Figure 5:
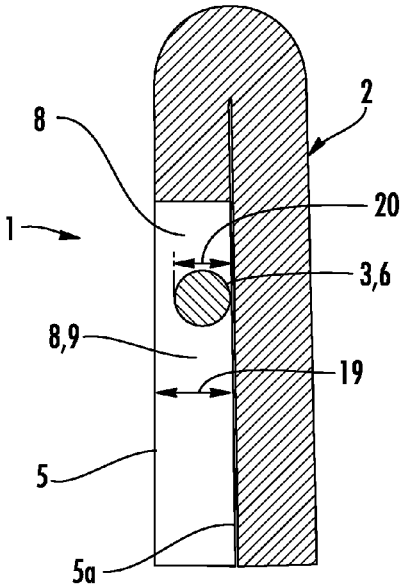
Figure 6:
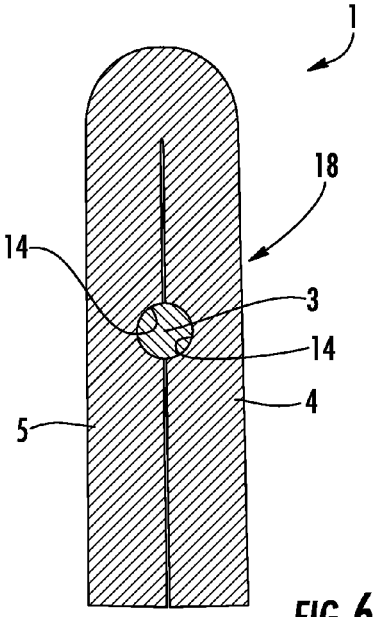
Figure 7:
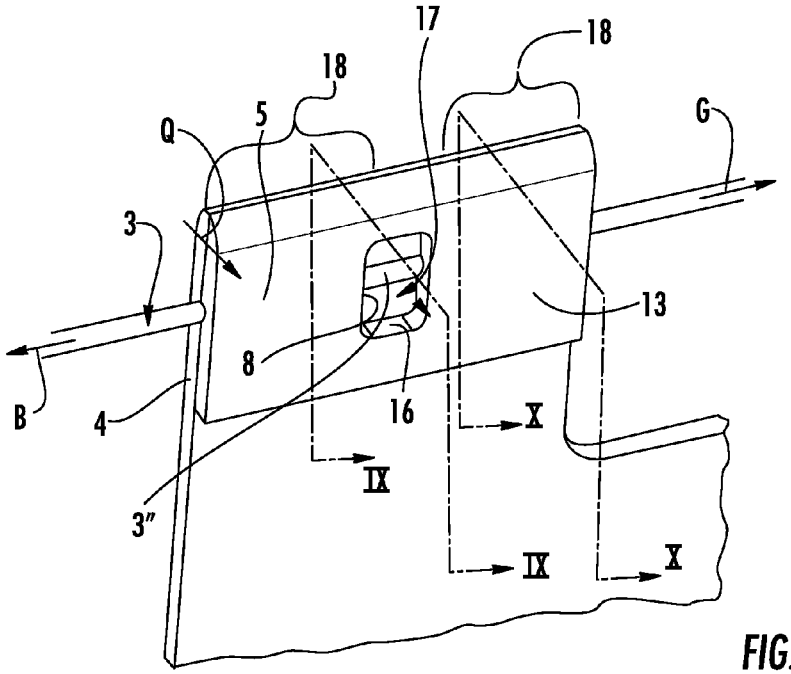
Figure 8:
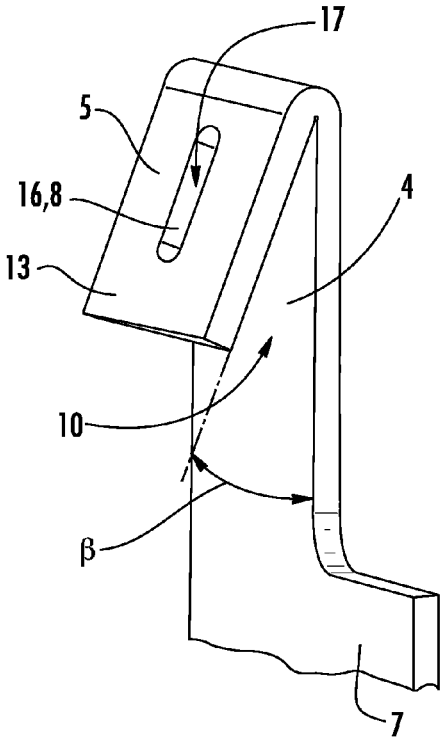
FIG. 8: The connecting arrangement of FIG. 7 in pre-mounted state (the wire has been left out for simplification purposes)
Figure 9:
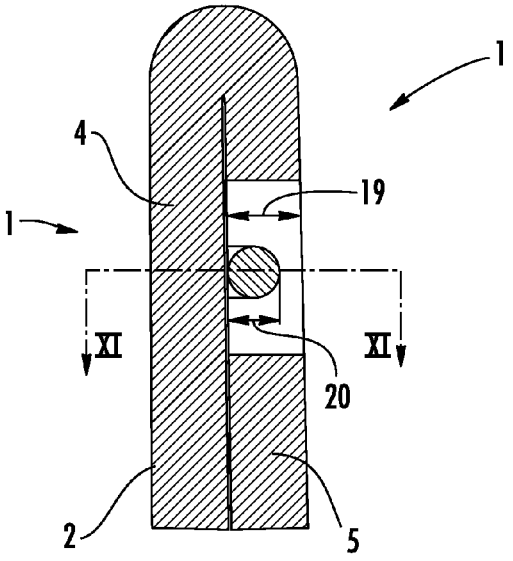
FIG. 9: A cross-sectional view corresponding to line IX-IX in FIG. 7, FIG. 10: A cross-sectional view corresponding to line X-X in FIG. 7, FIG. 11 A cross-sectional view corresponding to line XI-XI in FIG. 9, FIG. 12: A cross-sectional perspective view of another embodiment of a connecting arrangement in pre-mounted state (the wire has been left out for simplification purposes)
Figure 10:
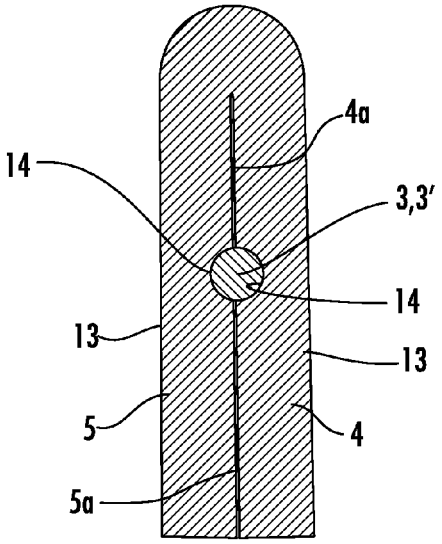
Figure 11:
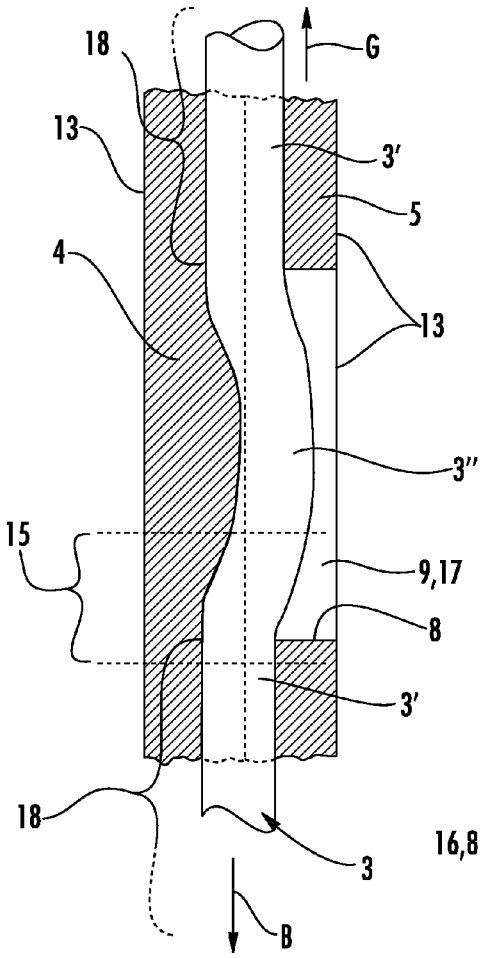
Figure 12:
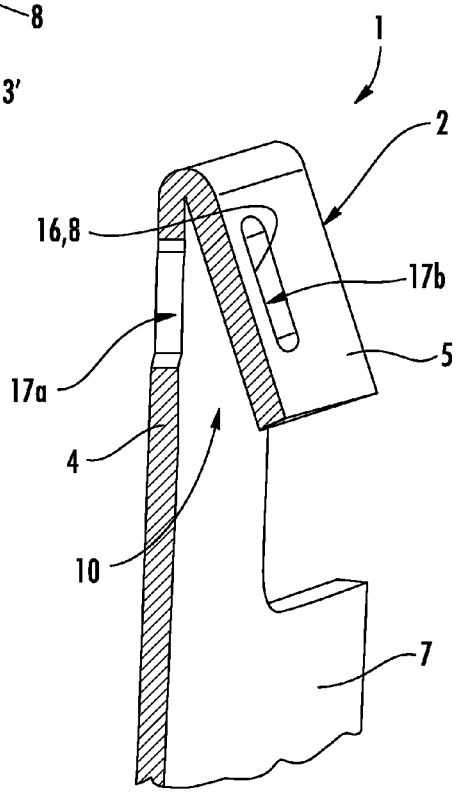
Figure 13:
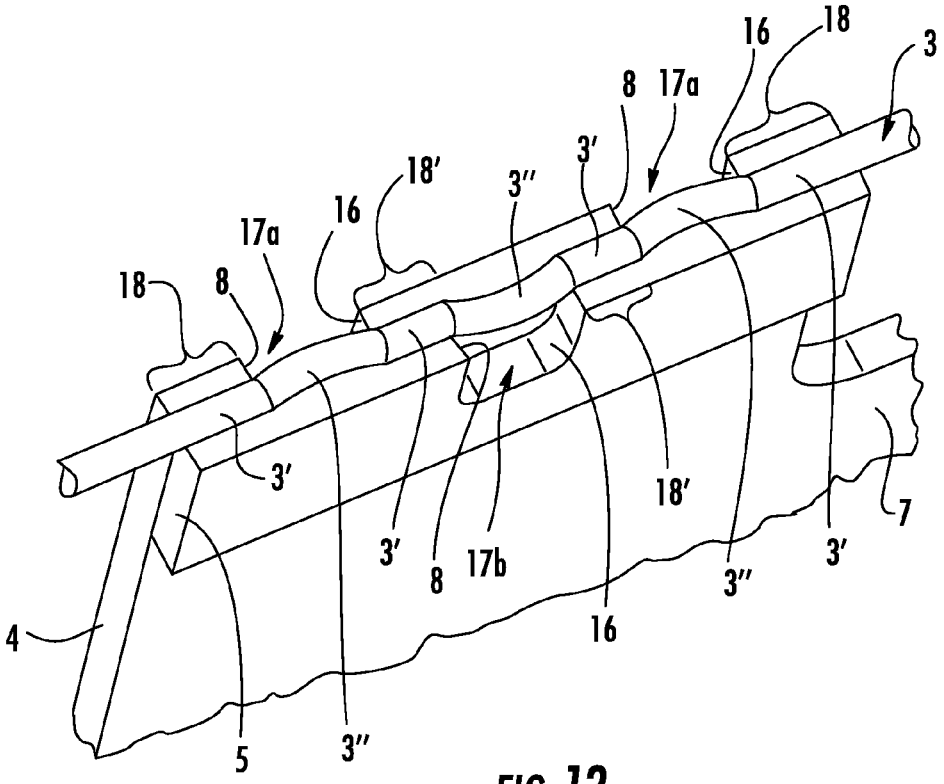
FIG. 13: A partially cross-sectional perspective view of the connecting arrangement of FIG. 12, with a sectional guide corresponding to line XI-XI in FIG. 8.

In addition to the above-mentioned force-fitting joint, the wire 3 is held by a form-fitting joint effective in load direction B between the clamping plates 4, 5. To accomplish this, a back gripping surface 8 is provided on at least one clamping plate 4*a*—in the embodiment shown in FIGS. 1 to 6, on the clamping plate 5—bumping against the clamping surface 5*a*, pointing against the load direction and extending transversally to the load direction B. Thus, the back gripping surface 8 encloses with the clamping surface 5*a* an angle $\alpha$ of 60° to 120°, preferably of 90°. The clamping surface 4*a* of the other clamping plate 4 extends against the load direction B beyond the back gripping surface 8. As a result of this, in the mounted state, a wire section 3" extending away from the back gripping surface 8 of the clamping plate 5 in opposite direction G of the load direction B is pressed into a back gripping space 9 extending in opposite direction G of the back gripping surface 8. In the wire section 3" clamped between the clamping plates 4, 5 one-half of its size extends into one of the clamping plates 4, 5. Consequently, the wire section 3" extending beyond the back gripping surface 8 in opposite direction G is moved in perpendicular transversal direction Q around a distance opposite the wire section 3', which corresponds to half of the diameter D/2 of the wire (see FIG. 4). According to this (only slight) lateral deflection of the wire section 3', the transition area 15 between the two wire sections 3' and 3" is only slightly bent and thus not executed with sharp edges.

Figure 2:
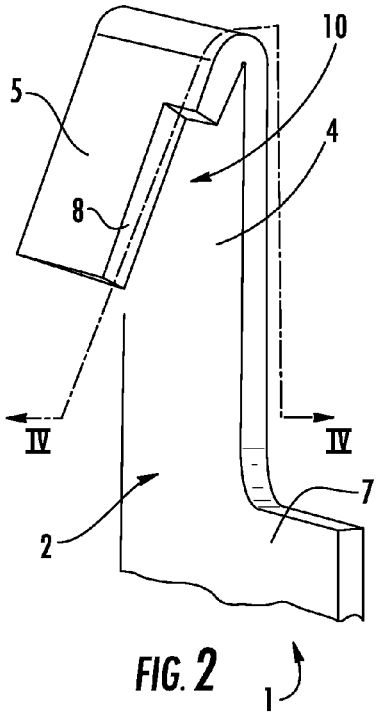
FIG. 2: The crimp connector of FIG. 1 in pre-mounted position.
Figure 3:
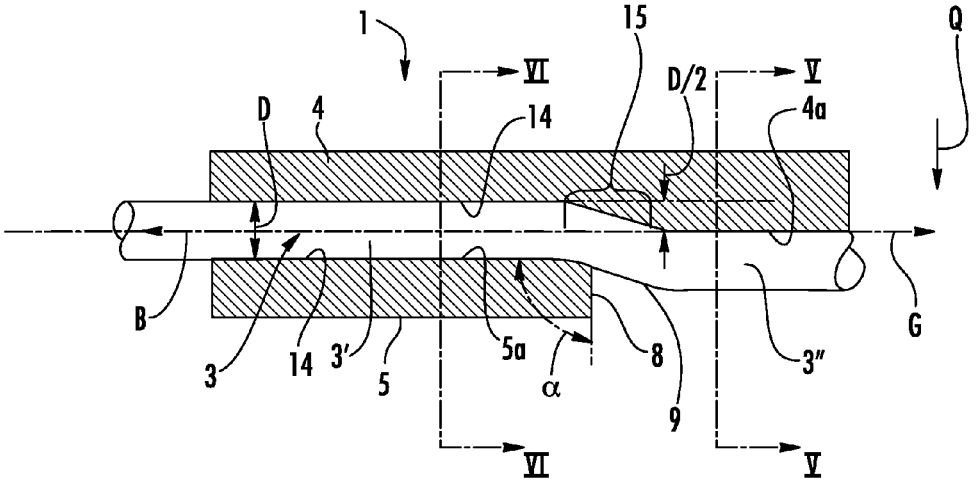
FIG. 3: A cross-sectional view of the connecting arrangement of FIG. 1 according to line III-III.

As can be easily recognized when FIG. 1 is compared with FIG. 2, wire 3 must be inserted in such a way into the space 10 between the clamping plates 4, 5 during mounting that it is positioned in the area of the back gripping surface 8. Around this target position S, in which the wire 3 and the back gripping surface 8 intersect (seen in the top view on an outer surface 13 of the clamping plates 4, 5), the clamping plates 4, 5 enclose an acute angle $\beta$ in the pre-mounted state without ensuring an additional technical assembly effort. The angle $\beta$ is chosen in such a way that the wire 3 is then located in the target position S when it abuts the clamping surfaces 4*a*, 5*a* of the clamping plates 4, 5. An adjustment to various wire thicknesses can take place by changing the angle $\beta$.

In the embodiments according to FIGS. 7 to 13, the back gripping surface 8 is part of the opening wall 16 of a slot opening 17 that opens up to the inner side 4*a*, 5*a* of the clamping plate 4, 5. The slot opening 17 extends preferably through the clamping plate 4, 5 and thus ends also in the outer side 13 of the clamping plates 4, 5. Moreover, the slot opening 17 is preferably arranged completely within the clamping plates. This has the advantage that it makes not only one clamping area 18 extending away from the back gripping surface 18 in load direction B available, but also a clamping area 18 extending away in opposite direction G to fix the wire 3 in place. The depth 19 of the slot opening 17 is at least as large as the thickness 20 of the wire 3. This ensures that a wire section 3" inserted through the slot opening 17 does not protrude above the outer side 13 of the clamping plate 4, 5 and is therefore protectively arranged in the slot opening 17.

In a preferred embodiment variant, the firmness of the connection between the wire 3 and the crimp connector 2 is increased by providing several slot openings 17. Compared to a slot opening 17*b* of the other clamping plate 4, 5, the slot opening 17*a* of a clamping plate 4, 5 is arranged in displaced way in load direction B. At the same time, the offset is measured preferably in such a way that there is a space between two successive slot openings 17*a*, 17*b* in load direction, i.e. that the slot openings do not overlap against one another. In this case, a clamping area 18' has been arranged between the opening slots 17, in which a wire section 3" has been clamped as described above.

The invention claimed is:

1. A connecting arrangement (1) comprising:

a crimp connector (2) and a wire (3) fixed in place in to the crimp connector, the crimp connector encompasses two clamping plates (4, 5) executed as one piece, that in a mounted state clamp the wire (3) between the two champing plates and fix the wire (3) firmly in place with a force acting in a longitudinal axial load direction (B), the interior sides of the clamping plates (4, 5) facing one another, at least in the mounted state, are at least partially executed as level clamping surfaces (4*a*, 5*a*), the wire (3) is made of a material that is harder than the material of the clamping plates (4, 5), in the mounted state, the clamping surfaces (4*a*, 5*a*) of the clamping plates (4, 5) abut, whereby an area of the wire section (3') is pressed partially into the one and partially into the other clamping plate (4, 5) by displacing the clamping plate material, at least one clamping plate (4, 5) has at least one back gripping surface (8) that faces against the load direction (B) and extends transversally to the load direction (B) that collides with its clamping surface (4*a*, 5*a*), whereby the clamping surface (4*a*, 5*a*) of the other clamping plate (4, 5) extends beyond the back gripping surface (8) against the load direction (B), a wire section (3") extending beyond the back gripping surface (8) of a clamping plate (4, 5) against the load direction (B) from the clamping surface (4*a*, 5*a*) of the other clamping plate (4, 5) is pressed into a back gripping space (9) extending beyond the back gripping surface (8) in opposite direction of the load direction (B).

2. The connecting arrangement according to claim 1, wherein the back gripping surface (8) is part of the opening wall (16) of a slot opening (17) that opens up towards the interior side (4*a*, 5*a*) of the clamping plate (4, 5).

3. The connecting arrangement according to claim 2, wherein the slot opening (17) is arranged completely within the clamping plate (4, 5).

4. The connecting arrangement according to claim 2, wherein the slot opening (17) penetrates the clamping plate (4, 5).

5. The connecting arrangement according to claim 2, wherein the depth (19) of the slot opening (17) corresponds to at least the thickness (20) of the wire (3).

6. The connecting arrangement according to claim 2, several of the slot openings (17) exist, whereby one slot opening (17*a*) of a clamping plate (4) is arranged in a displaced way compared to a slot opening (17*b*) of the other clamping plate (5) in load direction (B).

7. The connecting arrangement according to claim 6, wherein a space exists in the load direction (B) between the slot opening (17*a*) of the one clamping plate (4) and the slot opening (17*b*) of the other clamping plate (5).

8. The connecting arrangement according to claim 7, wherein a clamping area exists (18') between the slot openings (17*a*, 17*b*) in which a wire section (3") is clamped between the clamping surfaces (4*a*, 5*a*).

9. The connecting arrangement according to claim 1, wherein in a pre-mounted state, the clamping plates (4, 5) enclose an acute angle (β), so a wire (3) inserted in a space (10) provided between the clamping plates (4, 5) abuts on a target position (S) on the clamping surfaces (4*a*, 5*a*) of the clamping plates (4, 5), in which the wire (3) and the back gripping surface (8) intersect on an outer surface (13) of the clamping plates (4, 5).

* * * * *